United States Patent [19]

Surawski et al.

[11] Patent Number: 4,793,085

[45] Date of Patent: Dec. 27, 1988

[54] ELECTRONIC FIRING SYSTEM FOR TARGET PISTOL

[75] Inventors: Stephen J. Surawski, Woodbury; Larry W. Cowles, South Windsor; John J. Muller, West Hartford, all of Conn.

[73] Assignee: Colt Industries Inc., New York, N.Y.

[21] Appl. No.: 7,881

[22] Filed: Jan. 28, 1987

[51] Int. Cl.[4] ..... F41C 19/12; F41C 27/12

[52] U.S. Cl. ..... 42/84; 42/1.05

[58] Field of Search ..... 42/84, 1.05; 89/28.05, 89/28.1

[56] References Cited

U.S. PATENT DOCUMENTS

| | | | |
|---|---|---|---|
| 1,459,284 | 6/1923 | Declaye | 42/1.05 |
| 2,337,145 | 12/1943 | Albree | 42/84 |
| 2,780,882 | 2/1957 | Temple | 42/84 |
| 4,329,803 | 5/1982 | Johnson et al. | 42/84 |
| 4,347,679 | 9/1982 | Grunig et al. | 42/84 |
| 4,494,329 | 1/1985 | Post et al. | 42/1.05 |

*Primary Examiner*—Charles T. Jordan
*Attorney, Agent, or Firm*—Richard A. Dornon

[57] ABSTRACT

An electronically operated pistol (10) has a frame (32) upon which is mounted a barrel (36) and a shell (12) which encloses virtually all moving parts. The pistol has a trigger (14) which, when pulled, moves a front section (56) of a trigger bar (48) carrying a magnet (80) of a Hall effect switch. The trigger bar has a rear section (58) connected to a solenoid (114) which is actuated by a current amplifier (104) in a control circuit (124) which includes the Hall effect switch. Both sections of the trigger bar are independently axially movable but are so connected as to be pivotable about the trigger in unison to perform a disconnect function in association with a sear (78). A switch (104) in the control circuit mounted on the barrel senses the presence of a chambered cartridge (92). The control circuit includes a first light emitting diode (26) which illuminates when a round is chambered and a second light emitting diode (28) which illuminates when control circuit power is low. Voltage comparators (132,130) in the circuit signal logic elements (136,146,148,140) when power is low or the second light emitting diode fails to properly illuminate in order to prevent actuation of the solenoid. An electronic failure, which causes current to be constantly directed through the solenoid, is sensed by a voltage comparator (152) which causes an oscillator (154) to rapidly flash the second light emitting diode.

19 Claims, 4 Drawing Sheets

.030

ELECTRONIC FIRING SYSTEM FOR TARGET PISTOL

TECHNICAL FIELD

This invention relates to electronically operated firearms; and more particularly, to target pistols.

BACKGROUND

Electronically operated firearms are known in the prior art. Such firearms have typically embodied a solenoid adapted to displace an element of the firing mechanism such as the firing pin, hammer or sear. One problem with conventional solenoid firing element arrangements in firearms is the difficulty in providing a simple safety scheme.

In addition, many electronically operated firearms utilize a capacitor to energize the solenoid. While a capacitor can adequately actuate a solenoid, there are leakage and discharge difficulties which ca reduce the service life of the battery.

Prior art electronic firearms have not incorporated round-in-chamber indicators which would illuminate a light emitting device or render the firearm inoperative upon indicator failure. While such an indicator is not a safety device and would only be an adjunct to the primary means of determining whether there is a round in the chamber, i.e., visually inspecting the chamber, it could offer some convenience to a shooter who is ready to fire.

DISCLOSURE OF INVENTION

An electronically operated firearm of the invention employs a solenoid to directly displace a trigger bar, thereby allowing for the utilization of a trigger bar safety of which many forms are known.

A firearm of the invention avoids the disadvantages inherent in a solenoid actuation circuit having a capacitor by using a current amplifier to actuate the solenoid. As an aspect of the invention, appropriate electronic logic circuitry may be associated with the current amplifier for preventing solenoid actuation under certain conditions.

An electronic round-in-chamber indicator is included in a firearm of the invention to provide quick reassurance to a shooter that the firearm is in condition for firing at a target and thereby render operation more convenient to a shooter who is ready to fire. In accordance with the invention, the round-in-chamber indicator includes a small mechanical switch to sense the presence of a chambered cartridge, an indicator circuit operatively connected to the switch and a light emitting device. As a further feature of the invention, circuitry is provided to sense a failure in the indicator circuit or the light emitting device and furnish an appropriate signal to the aforementioned logic circuit whereby the solenoid cannot be actuated.

Accordingly, it is an object of the invention to provide an electronically operated firearm for target shooting in which a trigger ba is displaced by a solenoid to fire the firearm.

Another object is to provide an electronically operated firearm incorporating a solenoid in which the solenoid is actuated by a current amplifier.

A further object is to provide an electronically operated firearm having an electronic round-in-chamber indicator system as a matter of convenience to a shooter.

These and other objects and advantages of the invention will become more readily apparent from the following detailed description, when taken in conjunction with the accompanying drawings, in which:

BEST MODE OF CARRYING OUT THE INVENTION

Figure 1:
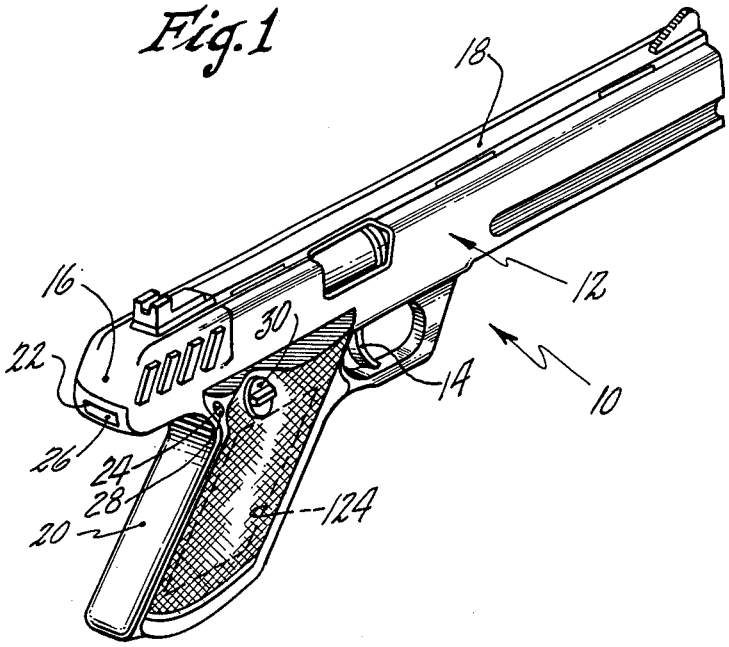
FIG. 1 is a perspective view of a semiautomatic pistol according to the invention.

Referring to the drawings, and more particularly to FIG. 1, there is shown an electronically operated firearm of the invention, generally designated 10. The firearm 10 is a semiautomatic pistol which is virtually identical in design to a mechanically operated pistol shown and described in U.S. patent application Ser. No. 931,287, filed Nov. 17, 1986 in the names of Larry W. Cowles et al and entitled Automatic Pistol. It will be appreciated that, although the invention will be described, for purposes of illustration only, with reference to the specific pistol of the aforementioned application, it has general applicability and may be utilized in different types of firearms.

With continued reference to FIG. 1, the pistol 10 will be seen as having a shell or housing 12 which encloses almost all moving parts, a trigger 14 and a charging handle 16 which constitutes part of the shell and is movable relative thereto. A sight bar 18 mounted upon the shell 12 carries front and rear sights. The shell 12 also defines a handle or grip portion 20. The shell 12 additionally embodies two windows 22 and 24 through which two light emitting diodes (LED's) 26 and 28, respectively, are visible. LED 26 functions as a round-in-chamber indicator light whereas LED 28 furnishes a signal when either battery power is low or a fault is present in the round-in-chamber indicator circuit. A rotary on-off switch 30 serves to control power to the circuitry which operates the pistol 10 so as to permit or inhibit operation of the pistol 10.

Figures 2, 3:
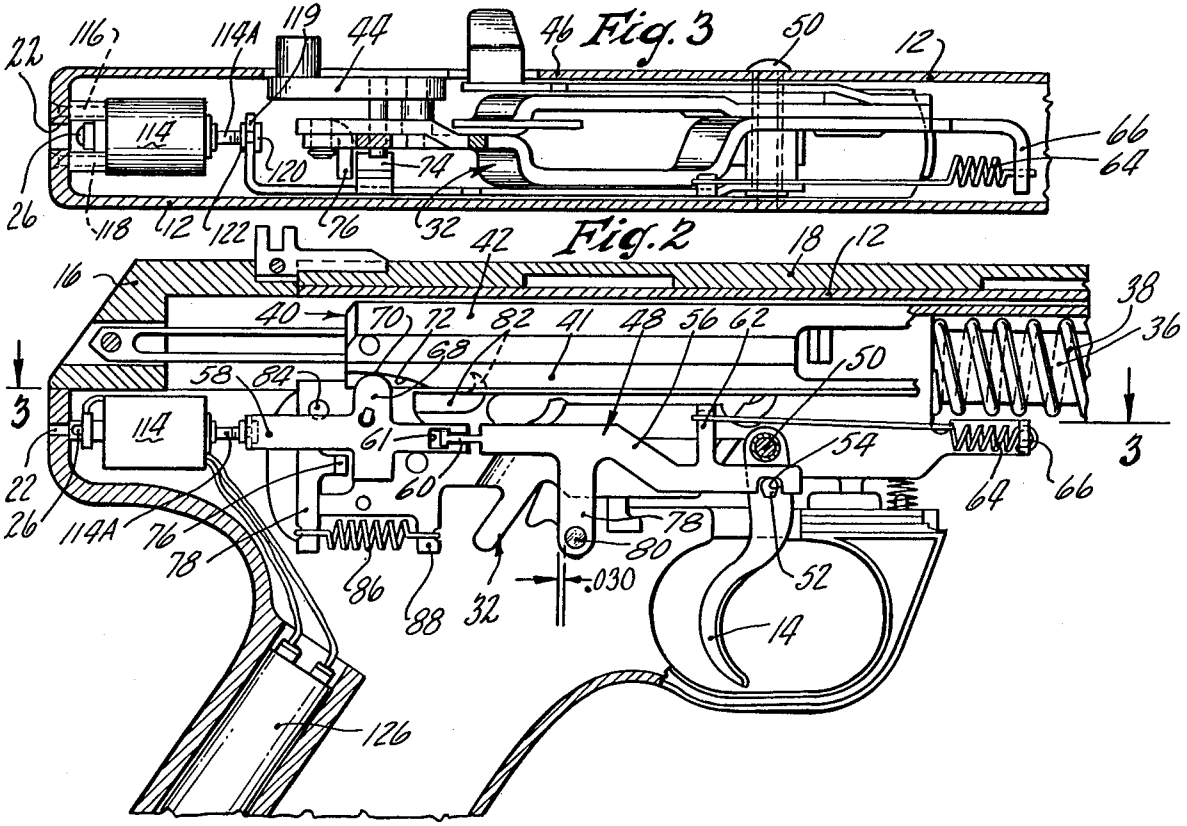
FIG. 2 is a fragmentary, right side elevational view, partly in section, of the pistol of FIG. 1.
FIG. 3 is a fragmentary, top plan, sectional view of the pistol of FIG. 1, taken substantially along the line 3—3 of FIG. 2.

As shown in FIGS. 2 and 3, pistol 10 comprises a frame, generally indicated at 32, to which all major assemblies and shell 12 of the pistol are attached. Frame 32 has a tubular section 34 which receives a barrel 36 and is brazed thereto. An operating spring 38 is coiled around the barrel 36 for driving a bolt carrier assembly, generally shown at 40, forwardly into battery position during counter-recoil. The bolt carrier assembly, which is mounted upon the barrel 36 for reciprocating movement between forward (battery) and rearward (recoil)

positions, includes a bolt 41, a carrier 42, a striker (not shown) and a shell extractor (not shown). Also mounted upon the frame 32 are a safety 44 and a bolt stop 46. For a more complete description of the construction and functioning of the foregoing elements reference should be had to the aforementioned patent application.

A trigger assembly is formed by the trigger 14 and a trigger bar generally designated 48. The trigger 14 is pivotally mounted upon a pin 50 which extends completely through the shell 12 as shown in FIG. 3. Trigger 14 has a lug 52 disposed in a notch 54 in the trigger bar 48 such that depression of the trigger results in a rearward axial movement of the forward section of the trigger bar, as is explained hereinafter.

The trigger bar 48 is essentially constituted by a forward section 56 and a rear section 58 which are connected in such a manner that rearward axial movement of either the forward section or the rear section directly produces no movement whatsoever of the other section. The sections 56 and 58 are, however, interconnected by means of a tang 60 on section 56 having an enlarged head portion which is slidingly received within an enlarged portion of a slot 61 in the forward end of section 58. The interconnection, while allowing for independent axial movement of the sections 56 and 58, permits pivoting of the trigger bar 48 about lug 52 as if it were a one-piece element. The trigger bar 48 has a vertical post 62 to which is connected an end of a tension spring 64. The other end of the tension spring is connected to a laterally extending mounting post 66 on the frame 32. An intermediate portion 68 of rear section 58 is of an enlarged width and L-shaped (as viewed in rear elevation) to provide an upper surface 70 to be engaged by a disconnect cam surface 72 on bolt 41 and a lower tab 74 to engage a confronting tab 76 on a sear 78 and engender pivoting thereof. As FIG. 2 reveals, the spring 64 applies a forward bias, as well as a clockwise bias (about lug 52), to the trigger bar 48 such that trigger return is constantly urged and the surface 70 is always in contact with the bolt 41. It should be readily apparent that upon recoil, the trigger bar 48 will rotate a few degrees in the counterclockwise direction due to the engagement between cam surface 72 and the trigger bar surface 70. Trigger bar 48 also has a depending post 78 having a small magnet 80 attached thereto for actuation of electronic circuitry as is discussed hereinafter.

The sear 78, which is generally L-shaped and has a hooked portion 82 for engaging the searing surface of the striker (not shown), is mounted upon the frame 32 for pivoting movement by means of a pin 84 which extends through an aperture in the rear portion of the frame 32. Engagement of the lateral tab 76 on the vertical leg of the sear 78 by the tab 74 on the rear section 58 of the trigger bar 48 during rearward movement of the latter results in a clockwise pivoting movement of the sear 78 which will release the striker. A tension spring 86, having one end secured to a post 88 of the frame 32 and the other end secured to the vertical leg of the sear 78, furnishes a counterclockwise spring bias to the sear 78, whereby the hooked portion will remain in engagement with the searing surface of the striker.

In order to furnish an electronic indication to a shooter as to whether a cartridge is chambered, some form of switch or sensor is required to sense the presence of such a chambered cartridge. FIGS. 4–7, inclusive, depict a preferred switch arrangement. While the electronic indicator 26 is useful in that it furnishes quick reassurance to a shooter who is ready t fire that a cartridge is present in the chamber, it is, nevertheless, merely an adjunct to the primary method of ascertaining whether or not there is a chambered cartridge, which would be to view the chamber through the ejection port. It will be appreciated, of course, that the electronic indicator is not a safety device and safety considerations mandate that it should never be relied upon for determining whether the pistol is loaded or unloaded.

Figure 4:
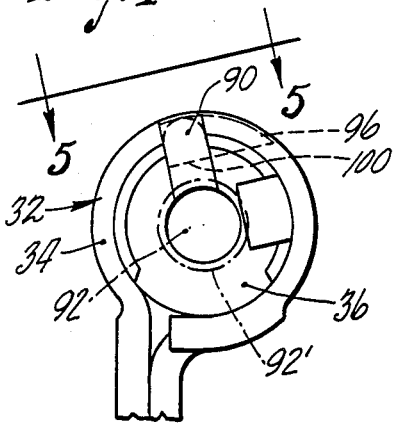
FIG. 4 is a rear elevational view of the tubular portion of the frame, showing the rear end of the barrel and a chambered cartridge.
Figure 7:
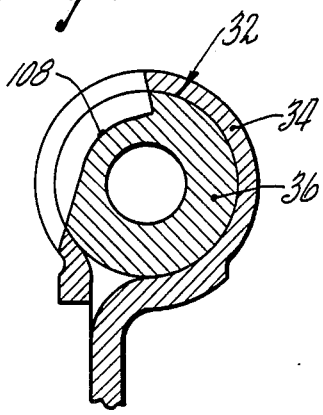
FIG. 7 is a sectional view of the frame and barrel, taken substantially along the line 7—7 of FIG. 5.
Figure 5:
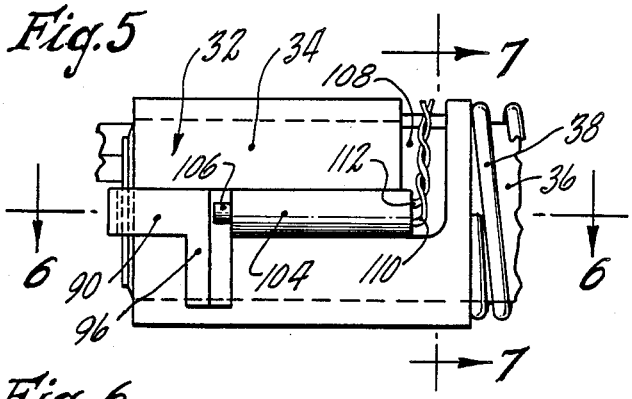
FIG. 5 is fragmentary top plan view of the frame and barrel, taken substantially along the line 5—5 of FIG. 4.
Figure 6:
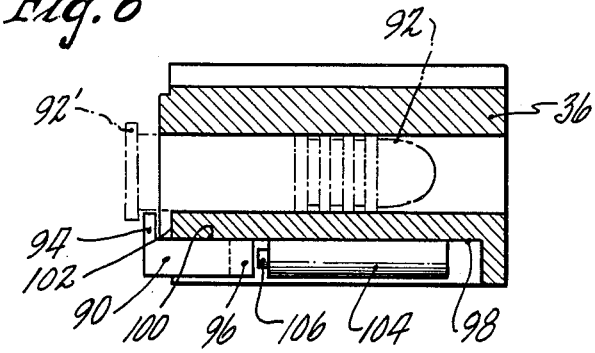
FIG. 6 is a sectional view of the frame and barrel, taken substantially along the line 6—6 of FIG. 5

FIG. 4 shows the rear end of the barrel 36 and the rear end of the tubular portion 32. A plunger 90 is mounted upon the barrel 36 for axial movement thereover in response to the chambering or extraction of a cartridge 92. Plunger 90 has a tang 94 whose end is contoured to fit over a cartridge casing. Tang 94 is of a length sufficient to have its end disposed radially inwardly of the outer periphery of the rim 92' of the cartridge 92, whereby movement of the cartridge 92 into chambered position occasions a forward axial displacement of the plunger 90. The plunger 90 is maintained in the illustrated angular orientation by a leg 96 (FIGS. 4,5 and 67) which is in orthoginal relationship to the tang 94 and has an outer surface which is curved to render it flush with the outer surface of the tubular portion 34. The inner surface of the leg 96 slides over a relieved surface 98 on the barrel 136, as does the under surface 100 of the plunger proper, whereby forward and rearward axial movement of the plunger is guided by such sliding contact. It will be noted in FIG. 7 that the barrel 36 is relieved at 102 to furnish a recess for reception of the tang 94 upon chambering of the cartridge 92.

A switch 104, having a spring loaded contact member 106, is mounted upon the relieved surface 98 of the barrel by epoxy and is axially positioned to have its contact member 106 fully depressed when tang 94 is in the recess defined by surface 102. Depression of contact member 106 renders the switch 104 conductive. As will be seen in FIGS. 5 and 6, barrel 36 has a further relieved surface 108 and an area of the tubular portion 34 is cut away to allow for passage of the lead wires 110 and 112 of the switch 104 to the control circuit. It will, of course, be appreciated that the switch could be of a form or type other than that illustrated provided it is capable of sensing the chambering of a cartridge.

A solenoid 114, which has no spring therein, is attached to the rear of the shell 12 by means of screws 116 and 118. As shown in FIGS. 2 and 3, the solenoid 114 has its axis extending longitudinally, generally parallel to that of the barrel 36. LED 26 is mounted upon the base of the solenoid in such a manner that it is visible through the window 22. The armature 114A has its end connected to a lateral extension 119 of the rear section 58 of the trigger bar 48 by means of nuts 120 and 122. That portion of the armature 114A lying between the nuts 120 and 122 is received within a slot in the lateral extension 119 so that the trigger bar 48 may pivot about the lug 52 without any vertical displacement of the armature. The solenoid is connected to a control circuit 124 in the grip portion of the shell which includes a power supply in the form of a battery 126.

When the trigger 14 is pulled, the control circuitry actuates the solenoid, thereby producing a rearward movement of armature 114A and, hence, the rear section 58 of the trigger bar 48. The signal to the control circuitry arises from the rearward movement of the magnet 80 in the front section of the trigger bar 48. Rearward movement of the rear section 58 causes the tab 74 thereon to engage the tab 76 on the sear 78, thereupon pivoting the sear clockwise and releasing the striker for movement into a chambered cartridge. After firing of the cartridge, the bolt carrier assembly 40 is driven rearwardly by the cartridge casing, thereby pivoting the trigger bar 48 in a counterclockwise direction, whereupon the tabs become disengaged. Such disengagement results in the sear 78 pivoting in a counterclockwise direction whereby the sear 78 will engage the striker on the counterrecoil stroke of the bolt carrier assembly 40. During further counterrecoil, the striker spring (not shown) will be compressed and, of course, a new round will be stripped from the magazine (not shown) and chambered. The rear section 58 will be returned to its original position by the trigger spring 64 during trigger return since the tang 60 will pull section 58 forwardly. To again fire the pistol 10, the trigger must be released so that the magnet 80 can assume its original or illustrated position. In this latter regard, it should be noted that the trigger bar 48 will pivot upwardly or clockwise as the bolt carrier assembly assumes its battery position and the disconnect cam surface 72 slides over the surface 70 of the rear section 58, thereby placing the tabs 76 and 74 in confronting relationship.

Figure 8:
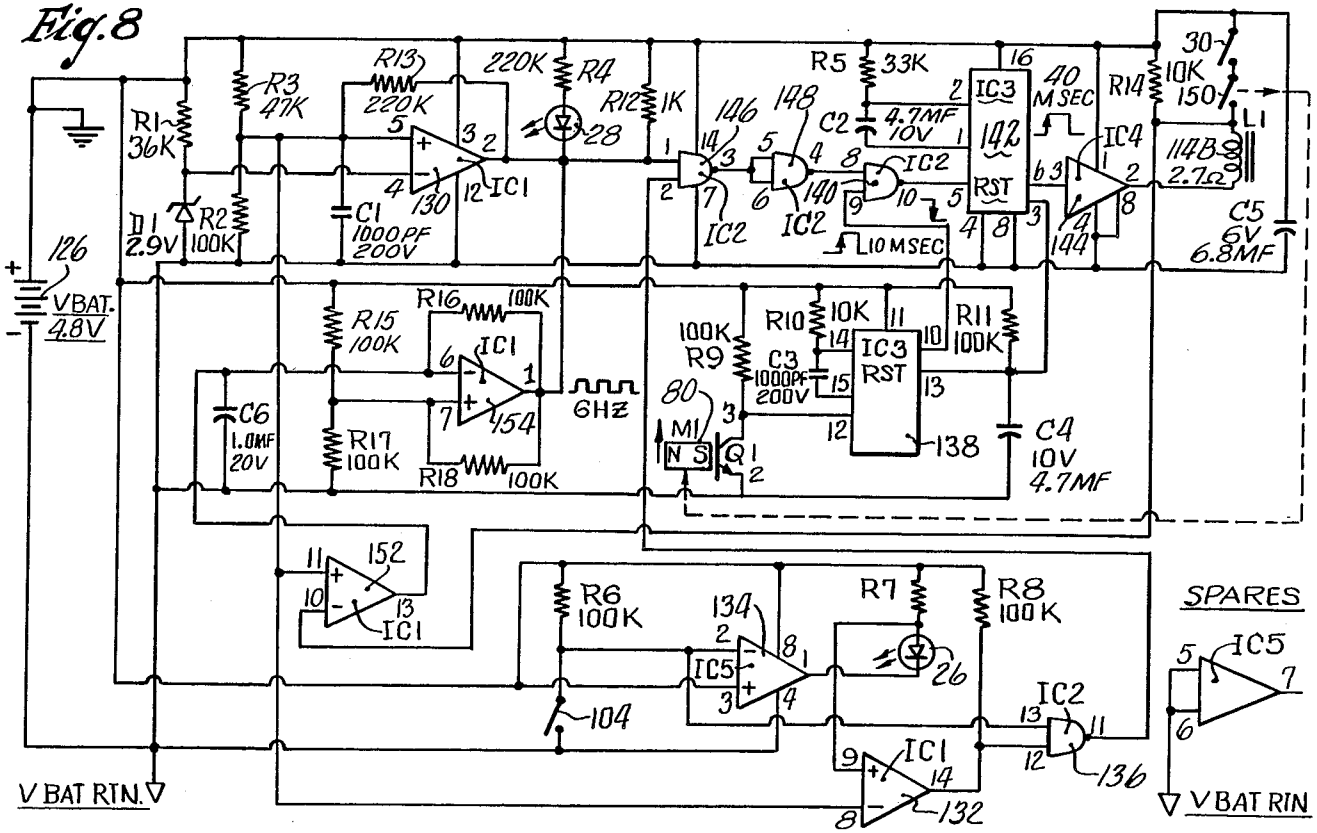
FIG. 8 is a schematic control diagram of the electronic control circuitry for the pistol of FIG. 1.

Turning to FIG. 8, the electronic control circuitry of the pistol 10 is shown. The electronic control circuitry illustrated includes five integrated circuits, viz.: IC1, IC2, IC3, IC4 and IC5. IC1 embodies four voltage comparator operational amplifiers. IC2 contains four NAND or inverting AND logic gates. IC3 has two monostable multivibrators which are both employed as one shot pulse generators. IC4 has two high gain, high current, Darlington transistor arrays, one of which is utilized and the other of which is a spare. IC5 incorporates two voltage comparator operational amplifiers, one of which is utilized and the other of which is a spare. Seven functions are developed by the above-enumerated integrated circuits: 1. Battery level monitoring; 2. Failure detection of round-in-chamber indicator circuit; 3. Failure detection of trigger circuit; 4. Pulse generator for trigger circuit output; 5. Pulse generator for solenoid driver circuit output; 6. Logic decisions for go-no-go conditions; and 7. Current amplifier for solenoid actuation.

Battery level monitoring is accomplished through the use of one of the voltage comparator operational amplifiers 130 in IC1 which has a feedback resistor R13. The inverting input pin 4 of amplifier 130 is connected to a voltage reference source located between a zener dode D1 and resistance R1 connected in parallel with the battery 126. The non-inverting input pin 5 of amplifier 130 is connected between resistances R3 and R2 of a voltage divider similarly connected in parallel with the battery. Since the voltage at pin 5 is normally higher than that of the voltage reference source at pin 4, the output voltage on pin 2 of amplifier 130 is at battery voltage level, thereby biasing off LED 28. However upon a decrease in battery voltage, the voltage at pin 5 of amplifier 130 decreases in a proportional manner while the reference voltage at pin 4 of amplifier 130 remains clamped at its reference level (2.9 volts) due to the Zener diode. When battery voltage decreases a sufficient amount (e.g., 3.9 volts in the illustrated circuit), a voltage difference will arise between amplifier 130 pins 5 and 4 such that the voltage at the former will be less than that at the leatter. Such a voltage differential causes output pin 2 to change state and drop to ground potential, thereby biasing LED 28 to an on condition. As is discussed hereinafter IC1, pin 2 also supplies a logic level input to IC2. To limit current through LED 28, a resistor R4 is provided in series therewith.

In order to detect failure of the round-in-chamber indicating circuit which illuminates LED 26, the third voltage comparator 132 of IC1 is utilized in conjunction with the first voltage comparator 134 of IC5 which is employed to direct current through LED 26 when switch 104 is closed. Essentially the comparator 132 monitors activity of the comparator 134 and the LED 26.

Pin 2 of IC5 (Comparator 134) monitors switch 104 by sensing the voltage between the switch 104 and a resistor R6 in series relationship therewith. Pin 3 of IC5 (Comparator 134) is connected to the same voltage divider as pin 5 of IC1 which is used to monitor battery level. The voltage at pin 3 is approximately two thirds the battery level which voltage furnishes a datum for comparing good switch contact for switch 104 and any malfunction of the round-in-indicator circuit when switch 104 is open. When switch 104 is open, pin 3 of comparator 134, the non-inverting input, is at a lower voltage, than pin 2, the inverting input. Hence, the output of IC5, pin 1, is at ground potential thereby biasing LED 26, which is connected thereto, to an on condition. When switch 104 closes, the voltage on IC5, pin 3, exceeds that of IC5, pin 2, thereby changing the output on pin 1 to the battery voltage which biases LED 26 to an off condition.

Comparator 132, the third stage of IC1, supervises the functioning of LED 26. The non-inverting input (pin 9) of comparator 132 is connected between LED 26 and a resistor R7. The inverting input (pin 8) of comparator 132 is connected to the same voltage divider as comparators 130 and 134. When the LED 26 is off, pin 14 of comparator 132 is at battery voltage level. Conversely, when LED 26 is illuminated, the output of comparator 132, at pin 14 thereof, is a ground potential. A NAND (inverting AND) gate 136, which is part of IC2, has its inputs, pins 12 and 13, respectively connected to the output of comparator 132 and the inverting input of comparator 134, whereby logic on or off levels are supplied to NAND gate 136 to indicate the state of the LED 26 and the position of switch 104. Should the switch 104 be open and the LED 26 be off, pin 13 of NAND gate 136 will be at battery voltage and pin 12 of NAND gate 135 will be at battery voltage, thereby causing output pin 11 of NAND gate 136 to be at a low logic level which will prevent firing as explained hereinafter.

In order to generate a pulse from the trigger circuit, it is necessary to actuate a one shot 138 which is part of IC3. Actuation of the one shot 138 is achieved through the use of a Hall effect digital switch consisting of the magnet 80 (MI) and a magnetic field sensing transistor Q1. The collector of transistor Q1 is connected to a resistor R9. Battery voltage is impressed across the series circuit defined by Q1 and R9. It should be noted that Q1 is normally conductive and is switched off by depression of the trigger 14 which causes the magnet 80 to be displaced away from the base of Q1. Switching off transistor Q1 causes a rising signal on pin 3 of Q1 and at pin 12 of one shot 138 which will cause the one shot to trigger. It will be appreciated that the one shot 138 will be triggered on only the rising edge of a signal (when magnet 80 moves away from the base of Q1 and not toward the base of Q1) and that the output at pin 10 of one shot 138 is a positive going pulse. In addition, it will be seen that resistor R10 and capacitor C3 provide resistor capacitor time constants for pulse width duration. Resistance R11 and capacitor C4, which are connected across the battery are connected to reset pin 13 of one shot 138 to prevent its actuation in the event the battery pack is inserted while the trigger is pulled and the power switch 30 is on. To fire the pistol it would be necessary to release and pull the trigger.

Assuming a favorable input to a NAND gate 140 from logic circuitry discussed hereinafter, generation of a pulse at pin 9 of NAND gate 140 will cause a negative going pulse at output pin 10 thereof. Pin 10 of gate 140 is connected to pin 5 of the other one shot 142 of IC3, whereby the negative going transition of the pulse at pin 10 will cause the one shot 142 to produce a positive going pulse at its output pin 6 which is utilized to drive the current amplifier for actuation of the solenoid and consequential axial displacement of trigger bar section 58. It will also be noted that the reset pin 3 of one shot 142 is connected between resistor R11 and capacitor C4 for the same reason that pin 13 of one shot 138 is so connected.

One of the Darlington transistor arrays in IC4, designated 144, is used as a current amplifier for actuation of the solenoid 114, the other array not being shown. Darlington array 144 inverts the low current signal from pin 6 of one shot 142 and provides an output (at pin 2 of the Darlington array 144) which is negative going and of the same amplitude and width. In the specific circuit illustrated, the Darlington array 144 is capable of supplying 1.5 amps to the solenoid coil and has a collector output sufficient to bring the solenoid coil to 1.1 volts above ground, which is the saturation voltage of the output stage of Darlington array 144. Capacitor C5 acts as a filter to supply current to the output.

Basic logic decisions are effected by means of the NAND gates in IC2, viz.: the previously mentioned gates 136 and 140 and gates 146 and 148. Pin 11 of NAND gate 146 receives as an input the output o comparator 130 which is normally (if battery voltage is not low) a high logic level signal (e.g., battery voltage). Similarly, pin 2 of NAND gate 146 typically receives a high logic level signal from NAND gate 136 when the round-in-chamber switch 104 is open and LED 26 is on since both of the inputs to the NAND gate 136 are at battery voltage. Having high level logic signals at both of the inputs of NAND gate 146 is, of course, the normal situation when the pistol 10 is ready to be fired and this event will occasion a go signal or low level logic signal on the output pin 3 of the NAND gate 146. Should one of the signals at the input of NAND gate 146 be of a low logic level or if both signals are of a low logic level, then a high level logic signal (a no-go-signal) will appear on pin 3 of NAND gate 146 and prevent pistol operation. NAND gate 148 functions to invert the low level logic signal on the output pin 3 of NAND gate 146 such that NAND gate 148 generates a high logic level signal on the output pin 4 thereof which is a go signal. When the high level logic signal form pin 4 of NAND gate 148 is applied to pin 8 of NAND gate 140 and a pulse form one shot 138 is applied to pin 9 of NAND gate 140, one shot 142 will be triggered as previously explained. I will be understood, of course, that a low level logic signal from pin 4 of NAND gate 148 as applied to pin 8 of NAND gate 140 will inhibit triggering of the one shot 142, and hence, firing of the pistol 10.

A switch 150, which interconnects on-off switch 30 and the solenoid coil 114B, is operatively connected to the magnet 80 for movement therewith such that a pulling of the trigger 14 not only moves the magnet 80 away from the transistor Q1 but also occasions a closing of switch 150. Upon closing switch 150, the terminal of the solenoid coil 114B is connected to battery potential via on-off switch 30. A voltage comparator 152 (which is part of IC1) is included to sense an electronic failure which would cause current to be directed through the solenoid coil 114B upon opening of the switch 150. Pin 11 of comparator 152 is connected to the same voltage divider (R2 and R3) as comparators 130,132 and 134 whereas pin 10 of comparator 152 is connected to a current sensing resistor R14 such that it receives the voltage drop thereacross as an input. When a low level input, indicating an electronic failure, is received at pin 10, the output at pin 13 changes in such a manner as excite an oscillator partially defined by a comparator 154, feed back resistors R16 and R18, a voltage divider formed by resistances R15 and R17 and capacitor C6. A change in the output of Comparator 152 (from ground to battery potential) causes previously shunted capacitor C6 t charge (through resistor R16) until the input at pin 6 of comparator 154 is about two thirds battery voltage so as to change the output at pin 1 of comparator 154. Upon a change in the output at pin 1, capacitor C6 discharges through resistor R16 until the output at pin 1 switches state. Upon this output change, the voltage at pin 7 drops to one third battery voltage. The result of successive discharges and charges of capacitor C6 is a wave form at pin 1 which causes LED 28 to flash on and off at about six times a second as pin 1 goes from batter to ground potential. The flashing of LED 28 indicates that prompt pistol repair is necessary.

In order to enable those skilled in the art to more fully appreciate the specific circuit illustrated, various component values and type designations have been assigned to the circuit elements. As to the IC type designation, the following is a preferred listing: IC 1-LM239AJ;IC 2-CD4011BD; IC3-CD4098BD; IC 4-ULN-2061M; and IC5-LM293AH. Q1 may be of IC type UGN-3019U and M1 is rated 420 Gauss at 0.100 inches minimum (Alinco VIII 0.212 Dia. x 0.187 Length). The solenoid is a Shindengen F194 C-3V solenoid. However, it will be understood that the description of the circuit is not to be considered limiting but is for purposes of illustration only and that the circuitry admits of many variations including the utilization of a single IC chip.

Obviously, many variations and modifications are possible in light of the above teachings without departing form the scope or spirit of the invention as defined in the appended claims.

We claim:

1. In an electronically operated firearm of the type having a trigger, a solenoid responsive to movements of the trigger and a sear operatively associated with the solenoid and responsive to actuation thereof, the improvement comprising: a trigger bar for displacing the sear having a front section connected to the trigger and a rear section connected to the solenoid, the sections of the trigger bar being interconnected such that each section is axially movable relative to the other section.

2. The improvement of claim 1, wherein the front section of trigger bar is mounted upon the trigger for pivoting movement and wherein the sections of the trigger bar are so interconnected as to permit pivoting of the front and rear sections in unison.

3. The improvement of claim 2, further comprising:
a current amplifier for actuating the solenoid; and
a voltage source connected to the current amplifier.

4. The improvement of claim 3, further comprising:
a first light emitting device; and
means to illuminate the first light emitting device upon deterioration of the voltage source.

5. The improvement of claim 4, further comprising:
a switch in the firearm to detect the presence of a chambered cartridge;
a second light emitting device;
means to illuminate the second light emitting device when the switch detects the presence of a chambered cartridge; and
means to detect failure of the second light emitting device to illuminate when the switch detects the presence of a chambered cartridge and to generate a failure signal.

6. The improvement of claim 5 further comprising:
means responsive to movement of the trigger for operating the current amplifier;
means to prevent operation of the movement responsive means when either the first light emitting device is illuminated or the failure detection means generates a failure signal.

7. The improvement of claim 1, further comprising:
electronic failure detection means to detect a flow of current through the solenoid when the trigger is released to provide an output indicative thereof; and
means responsive to the output of the electronic failure detection means to provide a flashing signal.

8. In an electronically operated firearm of the type having a barrel for receiving a cartridge, a trigger, a solenoid responsive to movements of the tripper and a sear operatively associated with the solenoid and responsive to actuation thereof, the improvement comprising:
a switch, having a contact member, mounted on the barrel;
a plunger, having a tang, mounted upon the barrel for axial movement thereover in generally parallel relationship thereto between a first position in which the tang engages a cartridge as it is being chambered in the barrel and a second position in which the contact member of the switch is so displaced by the plunger as to actuate the switch.

9. The improvement of claim 8, further comprising:
a light emitting device; and
means responsive to actuation of the switch to illuminate the light emitting device.

10. The improvement of claim 9, further comprising:
means to prevent actuation of the solenoid when the switch is actuated and the light emitting device is not illuminated.

11. In a firearm of the type having a barrel for receiving a cartridge in chambered position, a firing pin for striking and firing the cartridge, a sear for controlling movement of the firing pin, a solenoid for actuating the sear, a control circuit, including a power supply, for actuating the solenoid and a trigger for actuating the control circuit, the improvement in the control circuit comprising:
switch means to sense the presence of a chambered cartridge and provide an output indicative thereof whenever power is being supplied; and
signal means responsive to the output of the switch means to provide an illuminated signal whenever the presence of a chambered cartridge is sensed; and
failure detection means responsive to the output of the switch means to provide an output signal upon failure of the signal means to provide an illuminate signal whenever the presence of a chambered cartridge is sensed.

12. The improvement of claim 11, further comprising:
means to disable the control circuit in response to an output signal from the failure detection means to prevent solenoid actuation.

13. The improvement of claim 11, further comprising:
means to detect a low power condition in the control circuit to disable the control circuit and prevent solenoid actuation.

14. The improvement of claim 11, further comprising:
a current amplifier connected to the solenoid for the actuation thereof.

15. In a firearm of the type having a barrel for receiving a cartridge in chambered position, a firing pin for striking and firing the cartridge, a sear for controlling movement of the firing pin, a solenoid for actuating the sear, a control circuit, including a power supply, for actuating the solenoid and a trigger for actuating the control circuit, the improvement in the control circuit comprising:
a current amplifier connected to the power supply for supplying current to the solenoid having a duration the same as that of a current input pulse applied thereto;
means responsive to movement of the trigger to apply the current input pulse to the current amplifier for actuating the solenoid; and
means to prevent application of the current input pulse to the current amplifier when power supply voltage falls below a predetermined level.

16. The improvement of claim 15, wherein the trigger movement responsive means comprises:
a hall effect switch.

17. The improvement of claim 15, further comprising:
a first light emitting device; and
means to change the on-off state of the first light emitting device when the power supply voltage falls below a predetermined level.

18. The improvement of claim 17, further comprising:
a switch in the firearm to detect the presence of a chambered cartridge;
a second light emitting device;
means to illuminate the second light emitting device when the switch detects the presence of a chambered cartridge; and
means to detect failure of the second light emitting device to illuminate when the switch detects the presence of a chambered cartridge and to generate a failure signal.

19. The improvement of claim 15, further comprising:
electronic failure detection means to detect a flow of current through the solenoid when the trigger is released to provide an output indicative thereof; and
means responsive to the output of the electronic failure detection means to provide a flashing signal.

* * * * *